US007232297B2

(12) United States Patent
Beaven et al.

(10) Patent No.: US 7,232,297 B2
(45) Date of Patent: Jun. 19, 2007

(54) SCREW PUMP

(75) Inventors: Robert William Beaven, Bristol (GB); Michael John Werson, Eastleigh (GB)

(73) Assignee: Automotive Motion Technology Limited (GB)

( * ) Notice: Subject to any disclaimer, the term of this patent is extended or adjusted under 35 U.S.C. 154(b) by 78 days.

(21) Appl. No.: 10/839,992

(22) Filed: May 6, 2004

(65) Prior Publication Data

US 2004/0258550 A1 Dec. 23, 2004

(30) Foreign Application Priority Data

May 8, 2003 (GB) ..... 0310591.3
May 8, 2003 (GB) ..... 0310592.1

(51) Int. Cl.
*F01C 1/08* (2006.01)
*F03C 2/00* (2006.01)
*F04C 18/00* (2006.01)

(52) U.S. Cl. ..... 418/197; 418/180

(58) Field of Classification Search ..... 418/196, 418/197, 201.1, 206.1, 180
See application file for complete search history.

(56) References Cited

U.S. PATENT DOCUMENTS 630,648 A 8/1899 Brewer
2,079,083 A 5/1937 Montelius
2,231,357 A * 2/1941 Erb et al. ..... 418/197
2,455,022 A 11/1948 Schmidt
2,481,527 A 9/1949 Nilsson
2,588,888 A * 3/1952 Sennet ..... 418/197
2,590,560 A * 3/1952 Montelius ..... 418/197
2,652,192 A 9/1953 Chilton
2,693,763 A 11/1954 Sennet
2,764,101 A 9/1956 Rand
3,063,379 A * 11/1962 Montelius ..... 418/197
3,291,061 A * 12/1966 Shinohara ..... 418/197
3,519,375 A 7/1970 Sennett et al.
3,574,488 A * 4/1971 Vanderstegen-Drake .... 418/197
3,773,444 A 11/1973 Koch
3,814,557 A 6/1974 Volz
6,158,996 A 12/2000 Becher
6,312,242 B1 11/2001 Fang et al.
6,623,262 B1 * 9/2003 McKeithan et al. ..... 418/197

FOREIGN PATENT DOCUMENTS

DE 1004930 B 3/1957

(Continued)

OTHER PUBLICATIONS

United Kingdom Search Report issued in connection with priority application GB 030591.3.

(Continued)

*Primary Examiner*—Theresa Trieu
(74) *Attorney, Agent, or Firm*—Dykema Gossett PLLC

(57) ABSTRACT

A pump including at least three rotors each being provided with a generally helical screw thread, the rotors being mounted for rotation in a housing such that the screw threads of the rotors mesh and rotation of one rotor causes rotation of the other rotor, wherein the pitch of the threads is less than 1.6 times the outer diameter of the rotors or where one of the rotors has a larger outer diameter than the other rotors the outer diameter of the larger diameter rotor.

9 Claims, 5 Drawing Sheets

FOREIGN PATENT DOCUMENTS

| | | | |
|---|---|---|---|
| DE | 3718863 | A1 | 12/1988 |
| EP | 1008755 | A | 6/2000 |
| GB | 906430 | | 9/1962 |
| GB | 909.922 | | 11/1962 |
| GB | 914658 | | 1/1963 |
| GB | 954426 | | 4/1964 |
| GB | 2352777 | A | 2/2001 |

OTHER PUBLICATIONS

United Kingdom Search Report issued in connection with priority application GB 0310592.1.
European Search Report of Jul. 27, 2004 issued in connection with corresponding European application.

* cited by examiner

SCREW PUMP

This application claims priority to United Kingdom Patent Application No. GB0310591.3 filed May 8, 2003 and United Kingdom Patent Application No. GB0310592.1 filed May 8, 2003, the entire disclosures of which are incorporated herein by reference

FIELD OF THE INVENTION

The present invention relates to a pump, more particularly to a pump in which pumping is effected by means of at least two intermeshing screw threads, i.e. an intermeshing screw pump.

DESCRIPTION OF THE PRIOR ART

Pumps in which the pumped fluid is carried between the screw threads on one or more rotors such that the liquid is displaced in a direction generally parallel to the axis of rotation of the or each rotor, are known, and are generally referred to as screw pumps.

Where more than one rotor is provided, the pump is generally known as an intermeshing screw pump. In this case, one rotor is provided with one or more helical grooves and another rotor is provided with one or more corresponding helical ridges. Typically one of the rotors (the power rotor) is driven by motor, which when activated causes the power rotor to rotate along its longitudinal axis. The rotors are mounted in a housing such that their helical screw threads mesh and rotation of the power rotor causes the other rotor or rotors (the idler rotor or rotors) to rotate about its/their longitudinal axis or axes.

Fluid is drawn into the pump at an inlet or suction end of the pump between the counter-rotating screw threads. As the rotors turn the meshing of the threads produces fluid chambers bounded by the threads and the pump housing. Fluid becomes trapped in the fluid chambers and continued rotation of the screws causes the fluid chambers to move from the inlet end of the pump to the high pressure outlet end of the pump. Fluid is ejected from the pump at the outlet end as fluid is displaced from the fluid chambers.

It is known to increase the pressure of the fluid output from such a pump by increasing the length of the screws, and as a consequence known high pressure screw pumps tend to be relatively long and are thus unsuitable for use in applications where high output pressure and a compact pump is required, for example in automotive applications where space in an engine compartment is limited.

According to a first aspect of the invention, we provide a pump including at least three rotors each being provided with a generally helical screw thread, the rotors being mounted for rotation in a housing such that the screw threads of the rotors mesh and rotation of one rotor causes rotation of the other rotors, wherein the pitch of the threads is less than 1.6 times the outer diameter of the rotors, or, where one of the rotors has a larger diameter than the other rotors, the outer diameter of the larger diameter rotor.

In known intermeshing screw pumps, the pitch of the threads, i.e. the axial distance between corresponding points on adjacent turns of the thread, is typically twice the outer diameter of the rotors or larger diameter rotor, and may be up to 2.4 times the outer diameter of the rotors or larger diameter rotor. Thus, for a given pump length, more fluid chambers are formed in a pump according to the invention than in a conventional pump, i.e. for a given number of fluid chambers, a pump according to the invention is shorter than a conventional pump. Since the pressure of fluid output from an intermeshing screw pump depends, in part, on the number of fluid chambers formed by the screw threads of the rotors, for a given pressure, a pump according to the invention may be shorter than a conventional pump. Thus, by virtue of the invention, a screw pump may be produced which is capable of delivering high pressure fluid and which is more suitable for use in confined spaces such as those found within an engine compartment of an automotive vehicle.

Preferably the pitch of the threads is less than 1.2 times the outer diameter of the rotors or larger diameter rotor.

The pitch of the threads may be less than the outer diameter of the larger diameter rotor, and may, for example, be 0.75 times the outer diameter of the rotors or larger diameter rotor.

Preferably the pitch of the threads is at least 0.5 times the outer diameter of the rotors or larger diameter rotor.

Preferably the thread depth of the screw threads is less than 0.2 times the outer diameter of the rotors or larger diameter rotor.

In conventional screw pumps, the thread depth of the screw threads is greater than 0.2 times the diameter of the larger diameter rotor. Whilst, decreasing the thread depth decreases the volume of each fluid chamber, and thus tends to decrease the volume output of the pump, use of a reduced thread depth has particular advantages.

One advantage of reducing the thread depth is that decreasing the thread depth also decreases the area of leakage paths which permit leakage of fluid from the fluid chambers, and thus reduces leakage from the fluid chambers and hence increases the volumetric efficiency of the pump. In addition, for a given rotor root diameter (the rotor outer diameter minus twice the thread depth), the overall diameter of a pump according to the invention may be reduced. Rotors with threads of lower depth are also easier and thus less expensive to machine. Thus, a more compact and more efficient pump may be produced at reduced manufacturing cost.

Any reduction in output volume may be compensated for by increasing the speed of rotation of the rotors.

Preferably the thread depth of the screw threads is less than 0.175 times the outer diameter of the rotors or larger diameter rotor.

The thread depth of the screw threads may be less than 0.15 times the outer diameter of the rotors or larger diameter rotor.

Preferably the thread depth of the screw threads is at least 0.1 times the outer diameter of the rotors or larger diameter rotor.

Preferably each rotor is provided with two generally helical interposed screw threads.

Preferably one of the rotors has a different outer diameter to the others.

The pump may include three rotors each being provided with a generally helical screw thread, the rotors being arranged such that a central rotor is located between the other two outer rotors and the screw threads mesh such that rotation of one rotor causes rotation of the other rotors, wherein the thread of the central rotor is a generally helical groove which extends radially inwardly of the central rotor, and the thread of the outer rotors is a generally helical ridge which extends radially outwardly of the rotor, and the outer diameter of the central rotor is smaller than the outer diameter of the outer rotors.

In such a pump, the main fluid chambers are formed between the thread or threads of the outer rotors and the pump housing, and as there are two such rotors, there are twice as many main fluid carrying chambers as in a conventional screw pump. Thus, by virtue of providing larger diameter outer rotors, the volume output of the pump may be increased.

Whilst the volume output of the pump may be increased by increasing the thread depth, as this also increases the volume of the main fluid carrying chambers, this has been found to have an adverse effect on the volumetric efficiency of the pump. By virtue of this embodiment of the invention, for a given pump speed, the volume output of the pump may be increased whilst retaining satisfactory volumetric efficiency.

Moreover, since the rotors are arranged side by side, the number of main fluid carrying chambers may be doubled, and hence the volume output of the pump increased, without increasing the length of the pump. Reduction of the central rotor outer diameter relative to the outer diameter of the outer rotors reduces the overall diameter of the pump, and thus a pump assembly according to this embodiment of the invention is particularly compact.

The pump may include three rotors each being provided with a generally helical screw thread, the rotors being arranged such that a central rotor is located between the other two outer rotors and the screw threads mesh such that rotation of one rotor causes rotation of the other rotors, wherein the thread of the central rotor is a generally helical ridge which extends radially outwardly of the central rotor, and the thread of the outer rotors is a generally helical groove which extends radially inwardly of the rotor, and the outer diameter of the central rotor is larger than the outer diameter of the outer rotors.

According to a second aspect of the invention we provide a rotor for a pump, the rotor being provided with a generally helical screw thread, wherein the pitch of the thread is less than 1.6 times the outer diameter of the rotor.

DESCRIPTION OF THE DRAWINGS

Embodiments of the invention will now be described with reference to the accompanying drawings in which.

DESCRIPTION OF THE PREFERRED EMBODIMENTS OF THE INVENTION

Figure 1:
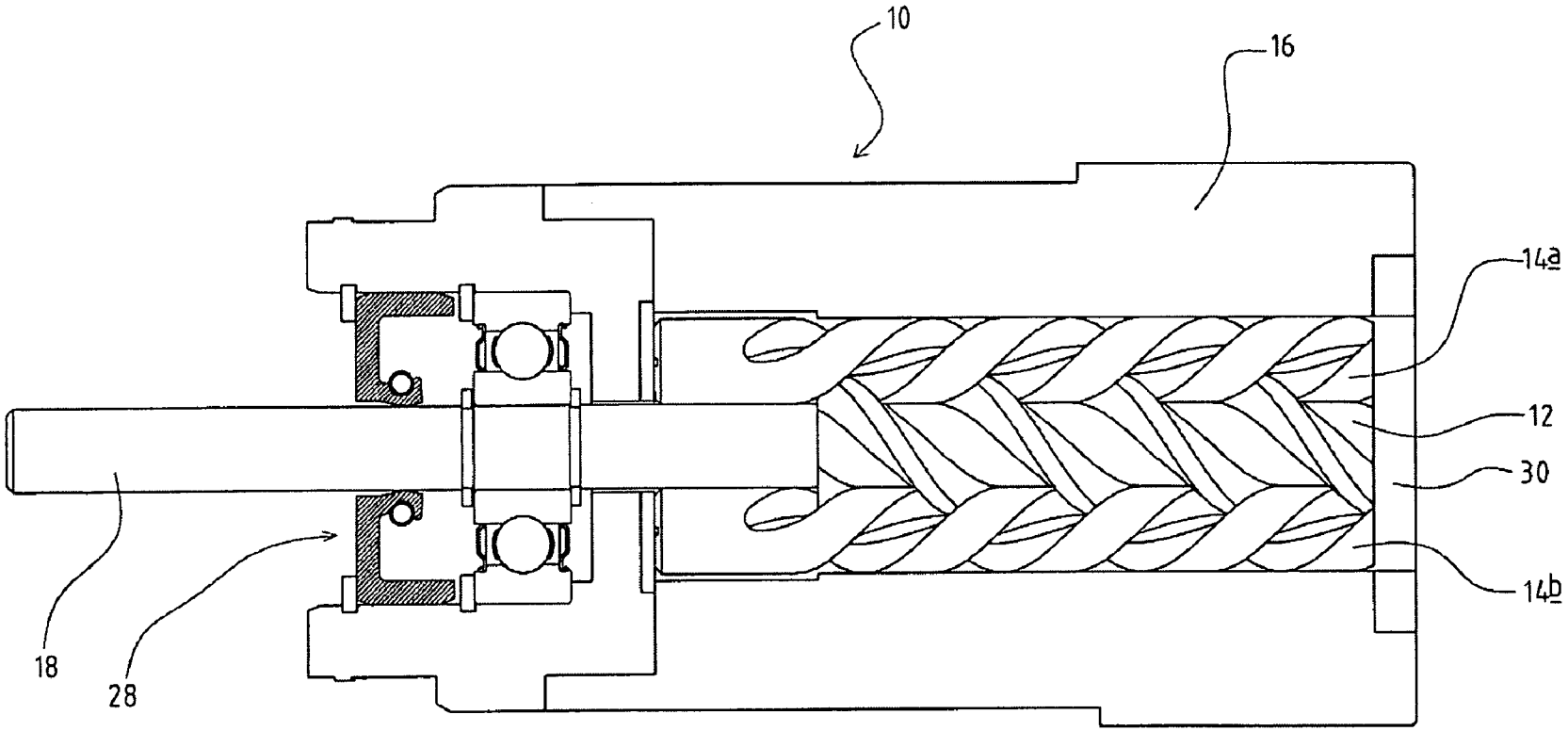
FIG. 1 is a side sectional illustrative view of a pump according to the invention.
Figure 2:
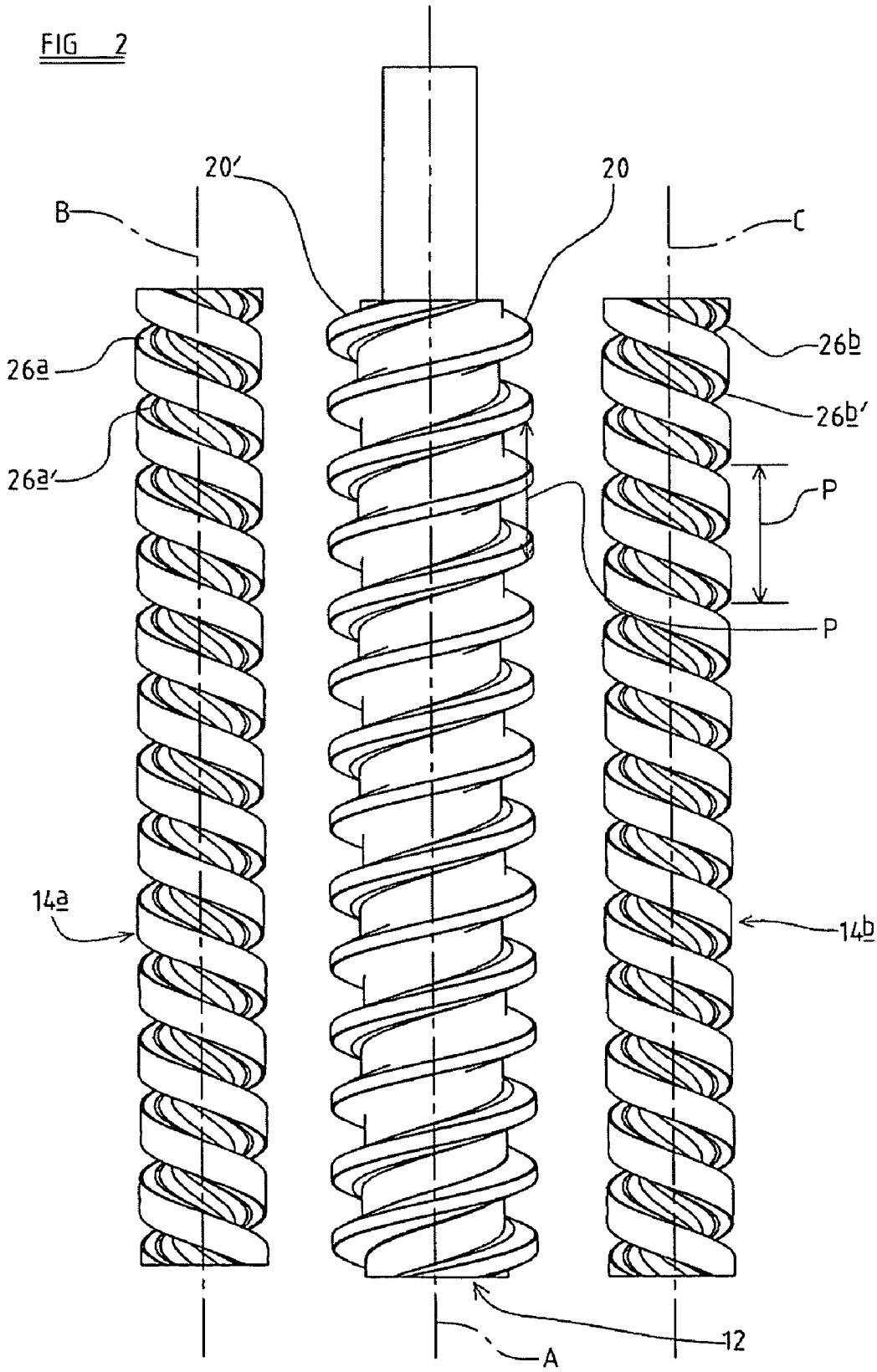
FIG. 2 is an enlarged illustrative view of the rotors of the pump of FIG. 1, the rotors being arranged in an inoperative position, side by side.
Figure 3:
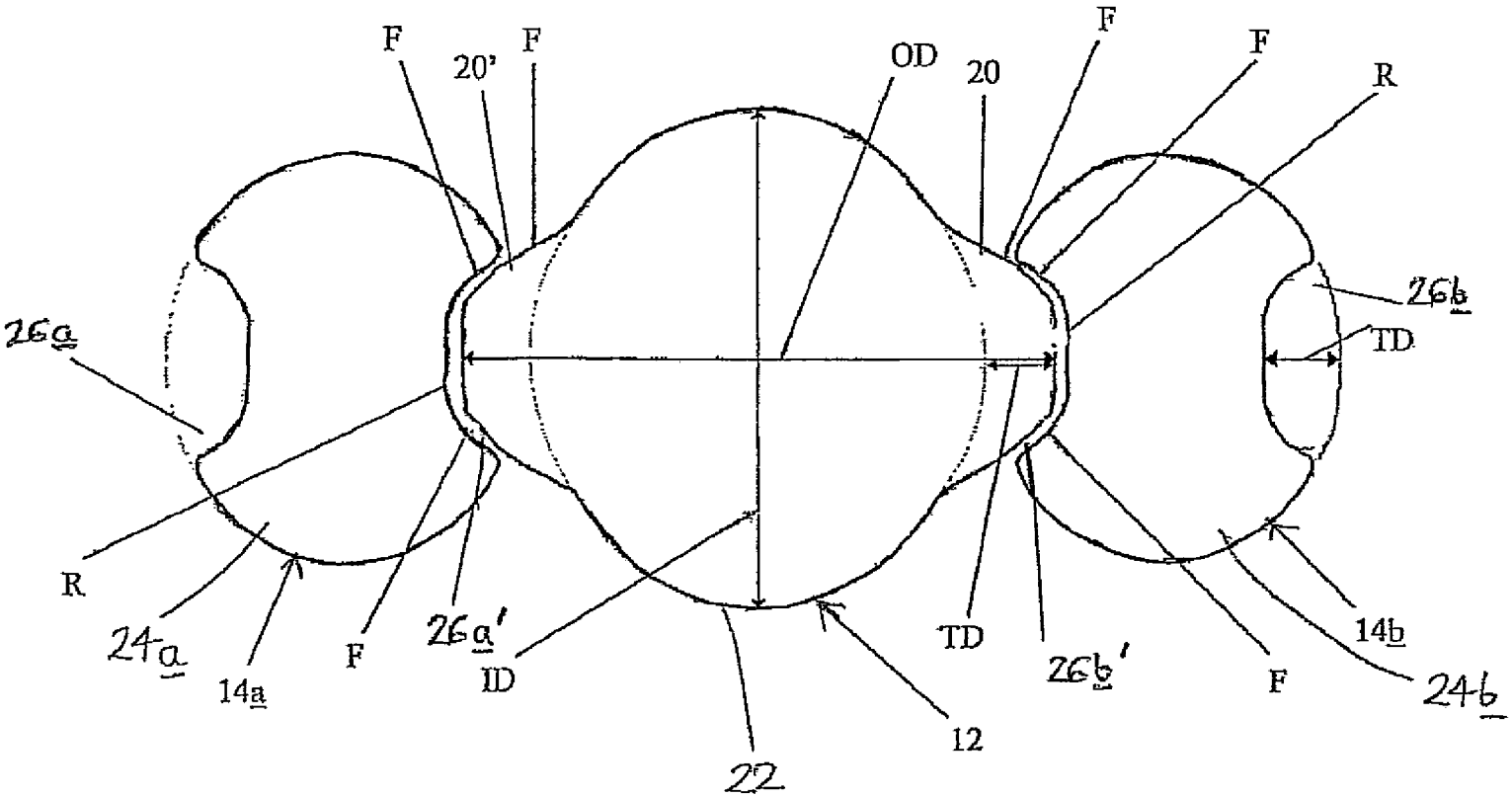
FIG. 3 is an illustrative end cross-sectional view through the rotors of the pump shown in FIG. 1.

Referring now to FIGS. 1, 2 and 3, there is shown a pump 10 including a central power rotor 12 and two idler rotors 14*a*, 14*b*, all mounted for rotation about their longitudinal axes in a housing 16. The power rotor 12 is connected to a driving means by means of a drive shaft 18, in this case an electric motor (not shown) which when activated, causes the power rotor 12 to rotate about its longitudinal axis A. The drive shaft 18 is supported in a bearing assembly 28.

The power rotor 12 has a larger outside diameter than the two idler rotors 14*a*, 14*b*.

Each rotor 12, 14*a*, 14*b* is provided with a generally helical screw thread, and the rotors 12, 14*a*, 14*b* are arranged in the housing 16, with the power rotor 12 between the two idler rotors 14*a*, 14*b*, such that the screw threads mesh. The longitudinal axes A, B and C of the rotors 12, 14*a* are generally parallel, and thus rotation of the power screw about axis A causes the idler rotors 14*a*, 14*b* to rotate about their longitudinal axes, B and C respectively.

In this example, the rotors 12, 14*a*, 14*b* are all provided with two generally helical threads or flights which each extend along substantially the entire length of the rotor 12, 14*a*, 14*b*, and which are interposed such that when the rotor 12, 14*a*, 14*b* is viewed in transverse cross-section, as shown in FIG. 3, one thread is diametrically opposite the other. The power rotor 12 has the shape of a generally cylindrical shaft 22 with the threads 20, 20', two generally helical ridges, extending radially outwardly around the shaft 22. The idler rotors 14*a*, 14*b* each have the shape of a generally cylindrical shaft 24*a*, 24*b* with the threads 26*a*, 26*a*', 26*b*, 26*b*', two generally helical grooves, extending radially inwardly into each shaft 24*a*, 24*b*.

An inlet port (not shown) is provided in the pump housing 16 adjacent a first end of the rotors 12, 14*a*, 14*b* and an outlet port 30 is provided in the pump housing 16 adjacent a second, opposite end of the rotors 12, 14*a*, 14*b*.

The pump is operated as follows.

The motor is activated to cause rotation of the power rotor 12 about axis A, which in turn causes rotation of the idler rotors 14*a*, 14*b* in the housing 16 about axes B and C respectively. Fluid is drawn into the inlet between the threads 20, 20', 26*a*, 26*a*', 26*b*, 26*b*'at the first ends of the rotors. As the rotors turn, the meshing of the threads produces fluid chambers bounded by the thread roots R, the thread flanks F and the pump housing 16. Fluid becomes trapped in the fluid chambers and continued rotation of the screws causes the fluid chambers to move from the first end of the rotors 12, 14*a*, 14*b* to the second end of the rotors 12, 14*a*, 14*b*. Fluid is ejected from the pump 10 via the outlet port 30 as a consequence of fluid being displaced from the fluid chamber as the screw threads at the second end of the rotors 12, 14*a*, 14*b* mesh.

The pitch of each thread 20, 20', 26*a*, 26*a*', 26*b*, 26*b*', i.e. the distance between corresponding points on adjacent loops of one of the threads 20, 20', 26*a*, 26*a*', 26*b*, 26*b*', marked as P on FIG. 2, is less than 1.6 times the outer diameter of the power rotor, marked as OD in FIG. 3, and is preferably less than the outer diameter OD of the power rotor 12, but at least 0.5 times the outer diameter OD of the power rotor 12.

For example, for a power rotor outer diameter OD of between 10 mm and 12 mm, and idler rotor outer diameters OD of around 7.2 mm, the pitch P of the threads 20, 20', 26*a*, 26*a*', 26*b*, 26*b*' is typically from 6 up to 9 mm.

The depth of each thread 20, 20', 26*a*, 26*a*', 26*b*, 26*b*', marked on FIG. 3 as TD, is less than 0.2 times the outer diameter of the power rotor 12. In this example, the outer diameter OD of the power rotor 12 is between 10 mm and 12 mm and the thread depth TD is between 1.4 and 1.7 mm inclusive.

In known intermeshing screw pumps, the pitch P of the threads 20, 20', 26*a*, 26*a*', 26*b*, 26*b*' is typically twice the outer diameter OD of the power rotor 12, and may be up to 2.4 times the outer diameter OD of the power rotor 12, whereas the thread depth TD is 0.2 times the outer diameter OD of the power rotor 12.

Thus, for a given pump length, more fluid chambers are formed in a pump 10 according to the invention than in a conventional pump, or, put another way, for a given number of fluid chambers, the pump 10 is shorter than a conventional pump. Since the pressure of fluid output from an intermeshing screw pump 10 depends on the number of fluid chambers formed by the screw threads 20, 20', 26*a*, 26*a'*, 26*b*, 26*b'* of the rotors 12, 14*a*, 14*b*, for a given pressure output, the pump 10 may be shorter than a conventional pump.

Moreover, since the thread depth TD is lower than for a conventional pump, for a given power rotor 12 root diameter RD, the overall pump diameter may be smaller than for a conventional pump.

Thus the pump 10 can be used where space is restricted such as in automotive applications, for example in an electrically operated power pack in which the pump is activated to produce pressurised fluid and the pressurised fluid is used to move an actuator member. Such an electrically powered power pack may be required for applications such as power steering.

It is advantageous to use a screw pump in such applications as screw pumps are relatively quiet compared with vane and gear pumps, for examples, and require only a relatively small motor in order to run at the high speeds, e.g. over 7,500 rpm, required to produce the fluid volume output needed for such applications.

The reduction in thread depth TD described above does have a consequence of reducing the volume of each fluid chamber in the pump 10, which in turn reduces the volume output of the pump when operating at a particular speed, but this can be compensated for by increasing the speed of rotation of the pump.

Use of the screw thread form described above also improves the efficiency of the pump 10. A screw pump using a conventional thread form which was scaled down to produce a pump of the same dimensions as a pump 10 according to the invention, operated at under 20% efficiency, whereas a relatively high efficiency (over 60%) has been achieved using the screw thread form described above.

During operation of the pump 10 leakage of fluid from the fluid chambers occurs along leakage paths between the flanks F of the meshing threads 20, 20', 26*a*, 26*a'*, 26*b*, 26*b'*, and between the exterior surfaces of the rotors 20, 14*a*, 14*b* and the housing 16 or the thread roots R. Such leakage reduces the efficiency of the pump 10.

Reduction of the thread depth TD reduces the size of the leakage path between the flanks F of meshing threads 20, 20', 26*a*, 26*a'*, 26*b*, 26*b'*, and reduction of the pitch reduces the size of the leakage paths between the outer surfaces and the root surfaces R of the rotors 12, 14*a*, 14*b*, and it is understood that this contributes towards the improved efficiency of the pump 10.

Use of the above described screw thread form also decreases the costs of manufacturing the pump 10.

The rotors 12, 14*a*, 14*b* are typically made by machining the thread forms into a cylindrical metal rod, and the tolerances must be tight in order to ensure that the threads mesh properly without leaving large fluid leakage paths and without the meshing threads becoming jammed during rotation of the rotors 12, 14*a*, 14*b*. The longer the rotor, the more difficult it becomes accurately to control a machine tool to produce a tight tolerance thread over the entire rotor length. Thus, for a given number of thread turns, it is easier, and hence less expensive, to manufacture a tight tolerance thread on the rotors 12, 14*a*, 14*b*, of the present invention than it would be to manufacture a longer rotor with a conventional thread form.

In addition, the complexity and hence cost of machining a tight tolerance thread form decreases with a reduced thread depth. This is at least partly because a reduction in root diameter RD increases the likelihood of the rotor 12, 14*a*, 14*b* bending during machining, and thus more care must be taken to produce a thread form of the required low tolerance. For a given rotor outer diameter OD, the root diameter RD of the rotors 12, 14*a*, 14*b* of the present invention is correspondingly larger than the root diameter RD of rotors of conventional design.

Figure 4:
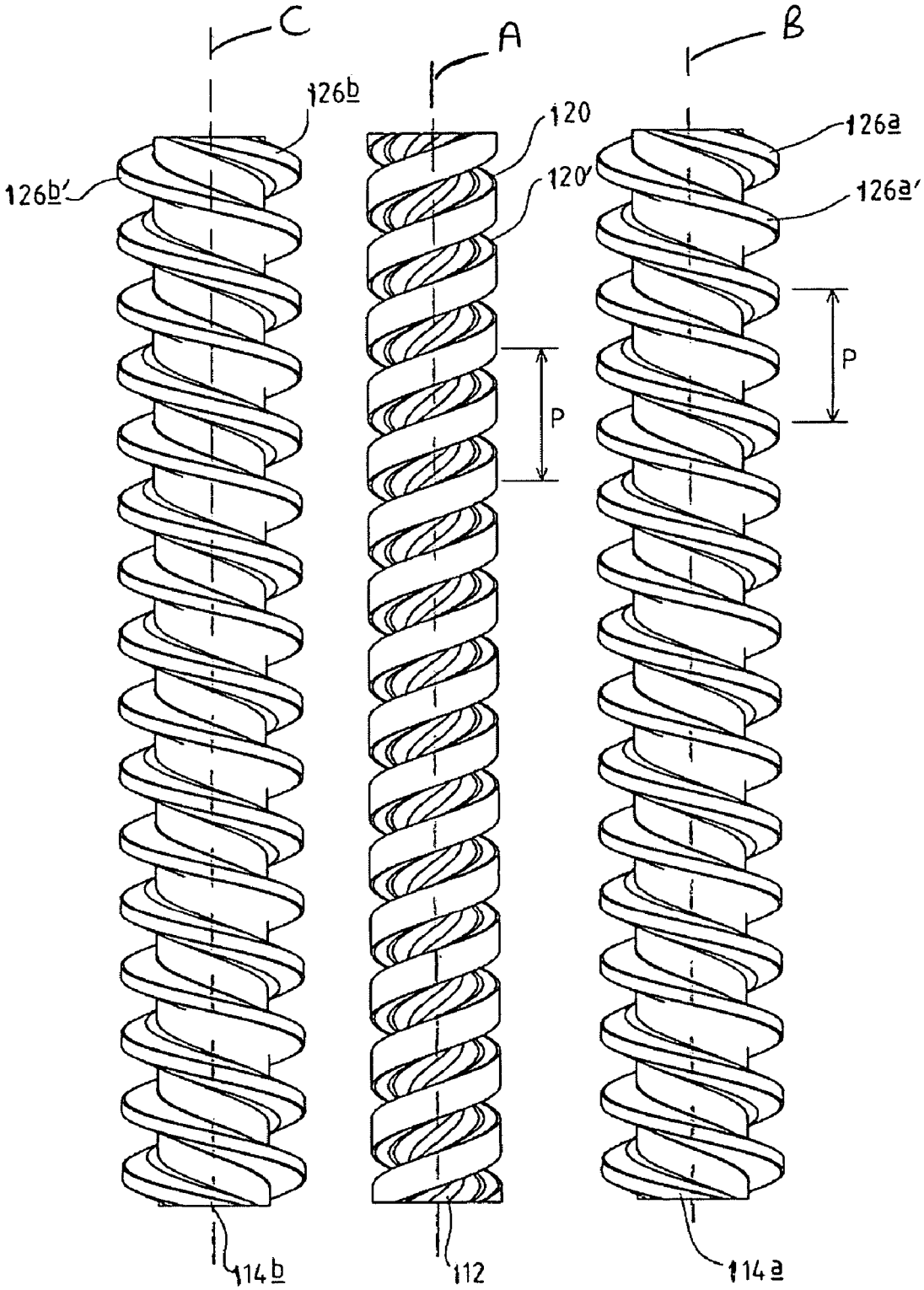
FIG. 4 is an illustrative view of the rotors of a second embodiment of pump according to the invention.
Figure 5:
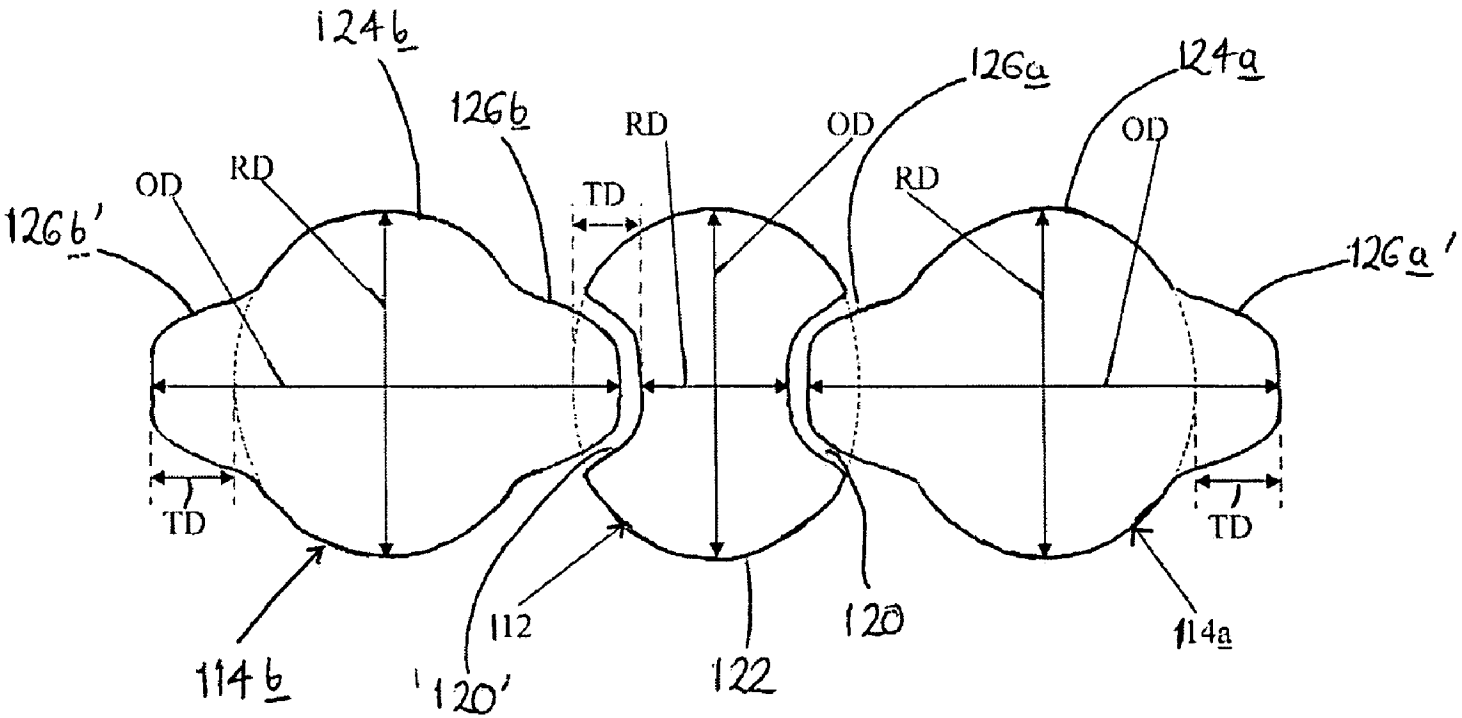
FIG. 5 is an illustrative end cross-sectional view through the rotors of the second embodiment of pump.

Referring now to FIGS. 4 and 5, there are shown rotors 112, 114*a* and 114*b* of a second embodiment of pump. These rotors 112, 114*a* and 114*b* are adapted to be used in a pump in the same manner as the rotors 12, 14*a*, 14*b* previously described.

The power rotor 112 has the shape of a generally cylindrical shaft 122 with the threads 120, 120', in the form of two generally helical grooves, extending radially inwardly into the shaft 122. The idler rotors 114*a*, 114*b* each have the shape of a generally cylindrical shaft 124*a*, 124*b* with the threads 126*a*, 126*a'*, 126*b*, 126*b'*, in the form of two generally helical ridges, extending radially outwardly of each shaft 124*a*, 124*b*.

The outer diameter OD of the power rotor 112 is smaller than the outer diameter OD of the idler rotors 114*a*, 114*b*. Typically, the outer diameter OD of the idler rotors 114*a*, 114*b* are 1.2 times the outer diameter OD of the power rotor 112. For example, for idler rotor 114*a*, 114*b* outer diameters of the order of 10 mm, the power rotor 112 outer diameter OD is of the order of 7 mm.

The pump is operated as follows.

When the rotors 112, 114*a*, 114*b* are mounted in a pump and the pump is activated, this causes rotation of the power rotor 112 about axis A, which in turn causes rotation of the idler rotors 114*a*, 114*b* in the housing about axes B and C respectively. Fluid is drawn into the inlet between the threads 120, 120', 126*a*, 126*a'*, 126*b*, 126*b'* at the first ends of the rotors. As the rotors turn, the meshing of the threads produces main fluid chambers bounded by the thread roots R' and the thread flanks F' of the two idler rotors 114*a*, 114*b* and the pump housing 116. Fluid becomes trapped in the fluid chambers and continued rotation of the screws causes the fluid chambers to move from the first end of the rotors 112, 114*a*, 114*b* to the second end of the rotors 112, 114*a*, 114*b*. Fluid is ejected from the pump via the outlet port as a consequence of fluid being displaced from the fluid chambers as the screw threads at the second end of the rotors 112, 114*a*, 114*b* mesh.

Thus, fluid is drawn into and ejected from the pump via two fluid chambers at any one time.

In contrast, in a conventional screw pump, the threads 120, 120' of the power rotor 112 are formed by two helical ridges, whereas the threads 126*a*, 126*a'*, 126*b*, 126*b'* of the idler rotors 114*a*, 114*b* are formed by two helical grooves. In this case, the main fluid chamber is formed between the thread roots and thread flanks of the power rotor 112 and the pump housing 116, and thus only one main fluid chamber is available at any one time to draw fluid into and eject fluid from the pump.

The pressure of fluid output from the pump increases with the increased number of main fluid chambers, and the provision of large diameter idler rotors 114*a*, 114*b*, further increases the volume of the fluid chambers which also increases the volume output of the pump. It is therefore possible, by adopting this embodiment of the invention to produce a pump which operates at the same pressure and volume output as a conventional pump, but which has shorter rotors. Thus the space occupied by the pump is reduced.

Thus this embodiment pump is particularly useful where high output pressure is required and space is restricted, such as in automotive applications, for example in an electrically operated power pack in which the pump is activated to produce pressurised fluid and the pressurised fluid is used to move an actuator member. Such an electrically powered power pack may be required for applications such as power steering.

The provision of a smaller pump also has a further advantage that less material is required to manufacture the pump, and thus the cost of the unit is reduced.

The provision of a smaller diameter power rotor 112 has a further advantage that forces exerted on the bearing by the power rotor 112 as a result of fluid pressure within the pump 110 are reduced. Reduction of the forces on the bearing is desirable as it reduces energy losses as a result of frictional forces between the bearing and the power rotor 112, and reduces wear on the bearing, thus increasing the life of the bearing. The pitch of each thread 120, 120', 126*a*, 126*a*', 126*b*, 126*b*', i.e. the distance between corresponding points on adjacent loops of one of the threads 120, 120', 126*a*, 126*a*', 126*b*, 126*b*', marked as P on FIG. 4, is less than 1.6 times the outer diameter of the outer rotors 14*a*, 14*b*, marked as OD in FIG. 5, and is preferably less than the outer diameter OD of the outer rotors 14*a*, 14*b*, but at least 0.5 times the outer diameter OD of the outer rotors 14*a*, 14*b*.

For example, for an outer rotor outer diameter OD of 9 mm, the pitch P of the threads 120, 120', 126*a*, 126*a*', 126*b*, 126*b*' is typically from 7 up to 9 mm.

The depth of each thread 120, 120', 126*a*, 126*a*', 126*b*, 126*b*', marked on FIG. 5 as TD, is less than 0.2 times the outer diameter of the outer rotors 14*a*, 14*b*. In this example, the outer diameter OD of the outer rotors 114*a*, 114*b* are 9 mm and the thread depth TD is between 1.4 and 1.7 mm inclusive.

Various modifications may be made to the pump 10 within the scope of the invention.

For example, the rotors 12, 14*a*, 14*b* may be provided with fewer or more than two threads or flights per rotor. It would be possible, for example to provide three interposed threads on each rotor 12, 14*a*, 14*b* each having a pitch and thread depth as described above.

It is also possible to provide only a single idler rotor, or to provide more than two idler rotors. Moreover, where two or more idler rotors are provided, it is not necessary for the central rotor to be connected to the driving means—one of the outer rotors may be connected to the driving means, or both the central rotor and at least one of the outer rotors may be connected to the driving means.

It is also possible that the central rotor may be fixed relative to the driving means, and rotation of the rotors achieved by rotation of the pump housing about the longitudinal axis of the central rotor, for example by incorporating the pump housing in the rotor of an electric motor.

Whilst in the examples given, one of the rotors has a different outer diameter to the others, all rotors may have the same outer diameter.

We claim:

1. A pump including at least three rotors each being provided with a generally helical screw thread, the rotors being arranged such that a central rotor is located between the other two outer rotors, and the screw threads mesh such that the rotation of one rotor causes rotation of the other rotors, wherein the pitch of the threads is less than 1.6 times the outer diameter of the outer rotors, wherein the thread of the central rotor is a generally helical groove which extends radially inwardly of the central rotor, and the thread of each outer rotor is a generally helical ridge which extends radially outwardly of the outer rotor, and the outer diameter of the central rotor is smaller than the outer diameter of the outer rotors.

2. The pump of claim 1 wherein the pitch of the threads is substantially constant along the entire axial length of the rotors, and the thread depth of the screw threads is less than 0.2 times the outer diameter of the outer rotors.

3. A pump according to claim 1 wherein the pitch of the threads is less than 1.2 times the outer diameter of the outer rotors.

4. A pump according to claim 1 wherein the pitch of the threads is less than the outer diameter of the outer rotors.

5. A pump according to claim 1 wherein the pitch of the threads is 0.75 times the outer diameter of the outer rotors.

6. A pump according to claim 1 wherein the pitch of the threads is at least 0.5 times the outer diameter of the outer rotors.

7. A pump according to claim 1 wherein the thread depth of the screw threads is less than 0.175 times the outer diameter of the outer rotors.

8. A pump according to claim 1 wherein the thread depth of the screw threads is less than 0.15 times the outer diameter of the outer rotors.

9. A pump according to claim 1 wherein the thread depth of the screw threads is at least 0.1 times the outer diameter of the outer rotors.

* * * * *